US007367331B1

(12) United States Patent
Horinek

(10) Patent No.: US 7,367,331 B1
(45) Date of Patent: May 6, 2008

(54) ARROW QUIVER FOR CARRYING ARROWS

(76) Inventor: Deone Horinek, 4849 Falcon Dr., Frederick, CO (US) 80504

( * ) Notice: Subject to any disclaimer, the term of this patent is extended or adjusted under 35 U.S.C. 154(b) by 75 days.

(21) Appl. No.: 11/075,621

(22) Filed: Mar. 9, 2005

Related U.S. Application Data

(60) Provisional application No. 60/552,605, filed on Mar. 12, 2004.

(51) Int. Cl.
*F41B 5/06* (2006.01)

(52) U.S. Cl. ..... 124/86; 124/25.5; 224/916

(58) Field of Classification Search ..... 124/25.5, 124/25.7, 86; 224/916; 206/315.1, 315.11, 206/317, 579
See application file for complete search history.

(56) References Cited

U.S. PATENT DOCUMENTS

| | | | | | |
|---|---|---|---|---|---|
| 3,088,583 | A * | 5/1963 | Holtz | ..... | 206/315.11 |
| 3,337,028 | A * | 8/1967 | Glavan | ..... | 206/315.11 |
| 3,561,651 | A | 2/1971 | Ramsey | | |
| 3,696,978 | A * | 10/1972 | Gentellalli | ..... | 206/315.11 |
| 3,777,734 | A | 12/1973 | Rose | | |
| 4,156,496 | A | 5/1979 | Stinson | | |
| 4,607,606 | A | 8/1986 | Schaar | | |
| 4,823,764 | A | 4/1989 | Knaack | | |
| 4,995,372 | A | 2/1991 | Topel | | |
| D331,319 | S | 12/1992 | Stinson | | |
| 5,242,050 | A * | 9/1993 | Billings | ..... | 206/315.11 |
| 5,358,108 | A | 10/1994 | Celaya | | |
| 5,409,109 | A * | 4/1995 | Smith | ..... | 206/315.11 |
| 5,775,314 | A | 7/1998 | Michael et al. | | |
| 5,967,315 | A * | 10/1999 | Langtry, II | ..... | 206/315.11 |
| 6,390,085 | B1 | 5/2002 | Stinson | | |
| 6,390,294 | B1 * | 5/2002 | Fiore et al. | ..... | 206/315.11 |
| 6,431,162 | B1 | 8/2002 | Mizek et al. | | |
| 6,450,333 | B1 | 9/2002 | McClenahan et al. | | |
| 6,564,791 | B1 | 5/2003 | Hammen | | |
| 6,595,655 | B2 * | 7/2003 | Neeb | ..... | 362/154 |
| 6,595,687 | B2 * | 7/2003 | Godshaw et al. | ..... | 383/6 |
| 2002/0062826 | A1 | 5/2002 | Proctor | | |
| 2003/0106818 | A1 | 6/2003 | Fiore, Jr. et al. | | |
| 2003/0140913 | A1 | 7/2003 | Stinson | | |

FOREIGN PATENT DOCUMENTS

| | | |
|---|---|---|
| EP | 0 342 109 | 11/1989 |

* cited by examiner

*Primary Examiner*—John A. Ricci
(74) *Attorney, Agent, or Firm*—Emery L. Tracy

(57) ABSTRACT

An arrow quiver for carrying arrows is provided. The arrow quiver comprises a cross member having a first end and a second end. A gripping mechanism is secured to the first end of the cross member. A blade hood is secured to the second end of the cross member for forming a blade receiving pocket with the blade hood having a base and a cover with the cover movable from the base.

17 Claims, 7 Drawing Sheets

ARROW QUIVER FOR CARRYING ARROWS

The present application is a continuation of now abandoned provisional patent application Ser. No. 60/552,605, filed on Mar. 12, 2004, entitled "Hinged Arrow Quiver".

BACKGROUND OF THE INVENTION

1. Field of the Invention

This invention relates generally to an arrow quiver for carrying arrows and, more particularly, the invention relates to an arrow quiver with a component for holding broadhead arrows which can be opened or removed for the insertion of broadhead arrows thereby allowing the broadhead arrows to be easily withdrawn for use.

2. Description of the Prior Art

An archery quiver is used by an archer to safely transport arrows. Conventional archery quivers include a quiver hood or shell which covers the broadheads and protects both the archer from the broadheads and the broadheads from hunting or other environments. The arrows attached to the broadheads are typically secured for transport with an arrow spreader mounted to a bow with a quiver mounting bracket. Typically, there is no structure of the hood that holds the broadheads within a void formed by the hood and the broadheads may undesirably contact an inner wall of the hood and/or adjacent broadheads resulting in damage to the broadhead blades. In some conventional archery quivers, to better secure the arrows and prevent damage to the broadheads, a second arrow spreader is mounted near the broadhead. However, the second arrow spreader interferes with the broadhead during insertion and withdrawal of the broadhead.

Other conventional archery quivers may have a hood which is lined or filled with a foam material into which broadheads are inserted to prevent contact between the broadhead and the inner wall of the hood and/or adjacent broadheads. However, the foam material can dull the blades as the broadhead is inserted and withdrawn from the hood and is easily damaged, for example, torn and/or cut, as a result of the broadhead insertion and withdrawal. Also, the mechanical broadheads can open as they are inserted into the foam material.

Therefore, when a mechanical broadhead is inserted in the traditional quiver, one of several problems occurs. For instance, since the broadheads are designed to open when they come into contact with solid matter, pushing them into the foam of a standard quiver causes the blades to open. Also, quivers without the foam material and containing another gripper mechanism near the hood to hold the broadheads, usually leaves the broad heads exposed creating a safety issue since the blades are typically surgically sharp. Furthermore, leaving the blades of the broadhead exposed causes vibration of the blades upon the release of the arrow resulting in noise.

Accordingly, there exists a need for an arrow quiver for carrying arrows which can be opened or removed for the insertion of broadhead arrows thereby allowing the broadhead arrows to be easily withdrawn for use. Additionally, a need exists for an arrow quiver for carrying arrows which protects the blades of the broadhead arrows from damage and which protects the archer from injury. Furthermore, there exists a need for an arrow quiver for carrying arrows which maintains the broadhead arrows from inadvertently opening prior to contact with an intended target

SUMMARY

The present invention is an arrow quiver for carrying arrows. The arrow quiver comprises a cross member having a first end and a second end. A gripping mechanism is secured to the first end of the cross member. A blade hood is secured to the second end of the cross member for forming a blade receiving pocket with the blade hood having a base and a cover with the cover movable from the base.

In addition, the present invention includes a device for covering the blades of an arrow. The device comprises a base portion and a cover portion over the base portion and movable away from the base portion. Latching means releasably secure the base portion and the cover portion together.

The present invention further includes a method for carrying and storing arrows. The method comprises providing an arrow have at least one blade, providing a base and a cover, forming a blade receiving pocket between the base and the cover, moving the cover away from the base to expose the blade receiving pocket, positioning the blade of the arrow within the blade receiving pocket, moving the cover over the base, and enclosing the blade receiving pocket.

DETAILED DESCRIPTION OF THE PREFERRED EMBODIMENTS

Figure 1:
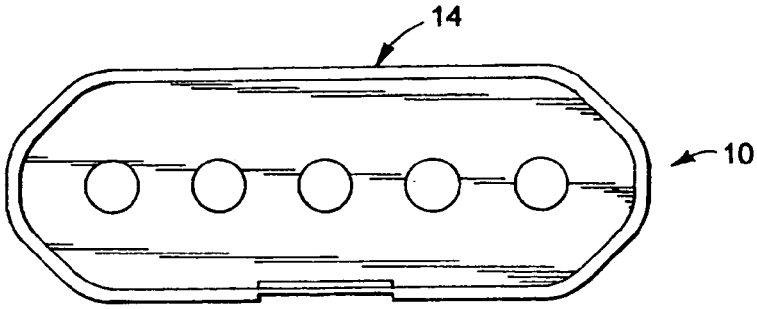
FIG. 1 is a front elevational view of an arrow quiver for carrying arrows, constructed in accordance with the present invention.
Figure 2:
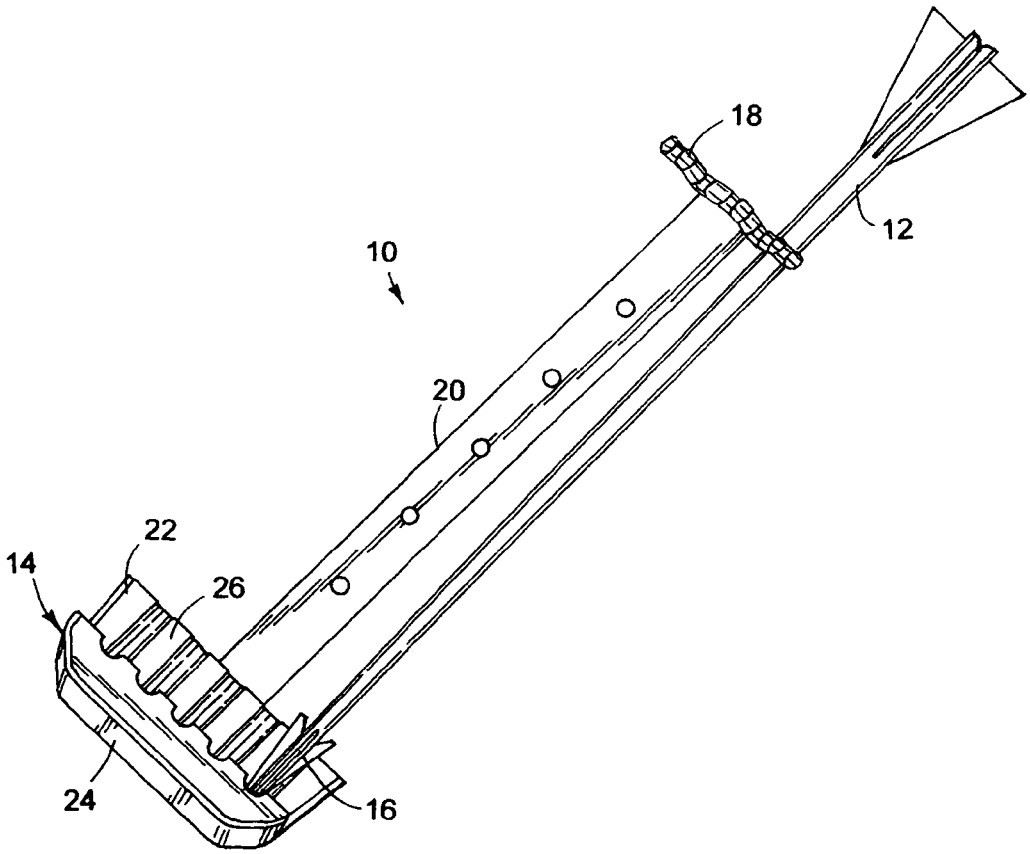
FIG. 2 is a perspective view of the arrow quiver for carrying arrows, constructed in accordance with the present invention.
Figure 3:
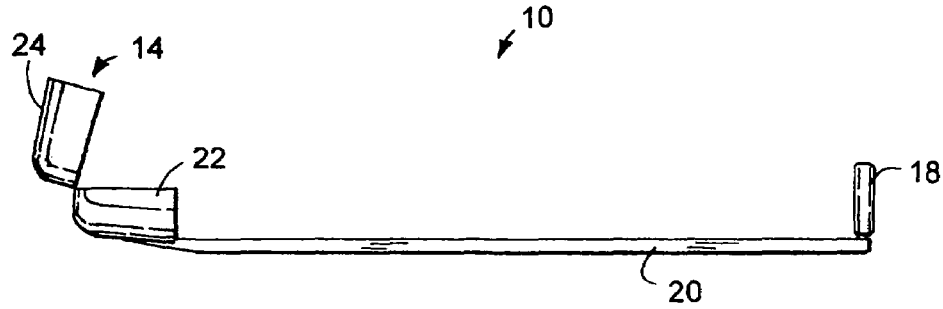
FIG. 3 is an elevational side view of the arrow quiver for carrying arrows, constructed in accordance with the present invention.
Figure 4:
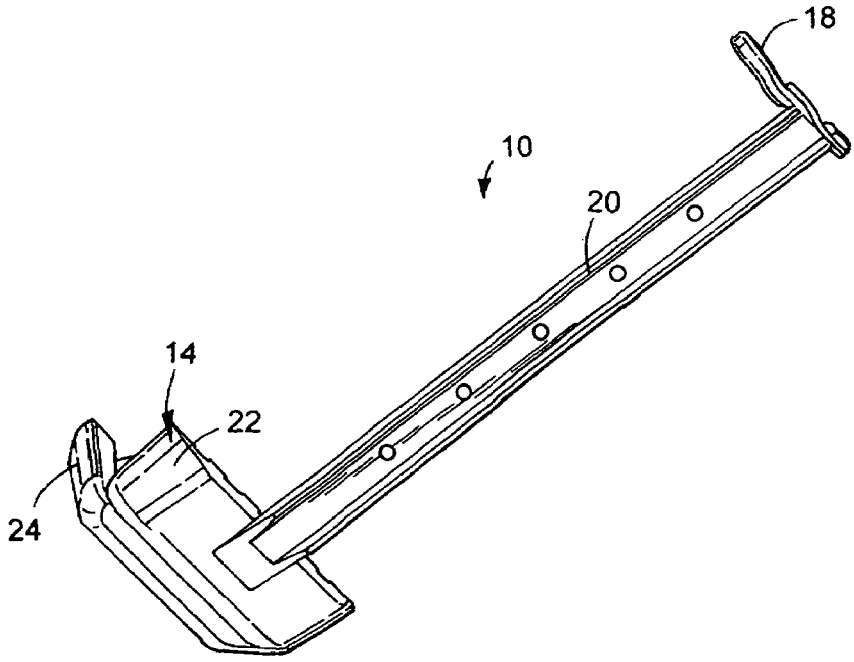
FIG. 4 is a perspective view of the arrow quiver for carrying arrows, constructed in accordance with the present invention.
Figure 5:
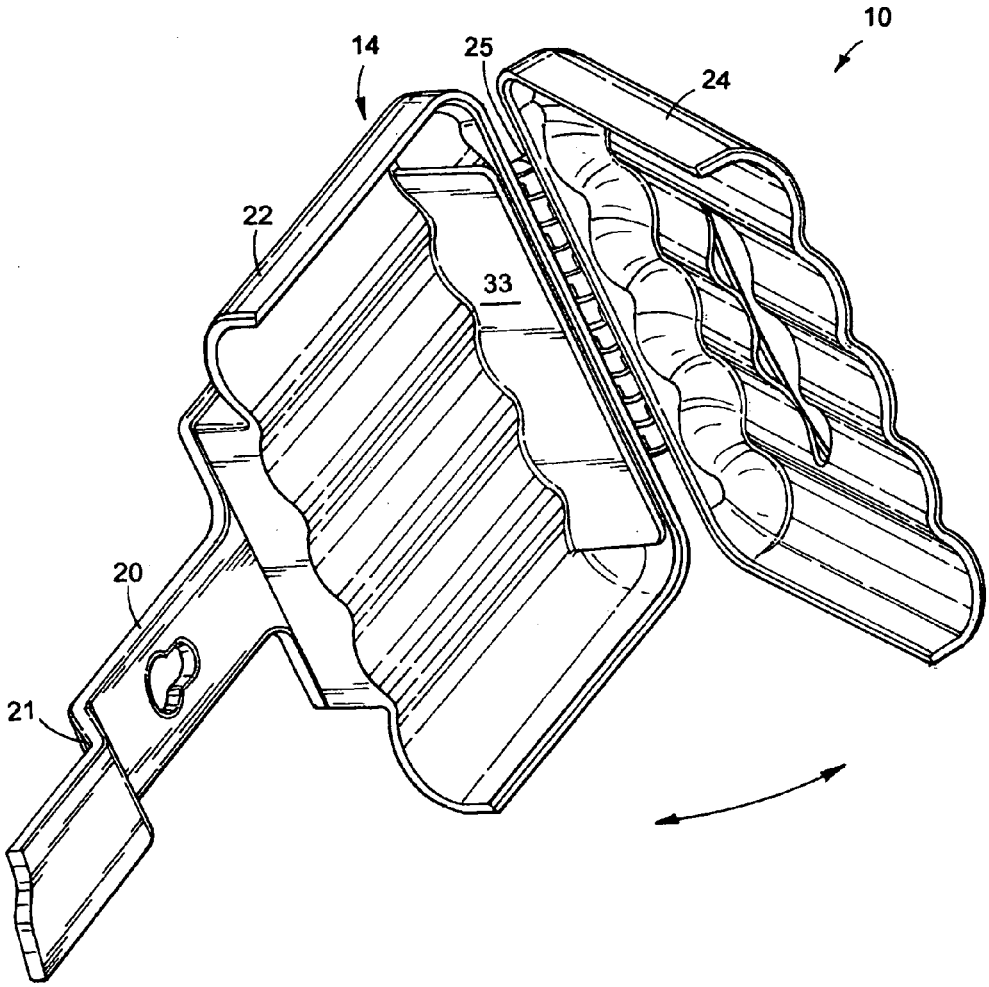
FIG. 5 is a perspective view of another embodiment of the arrow quiver for carrying arrows, constructed in accordance with the present invention, with a cover hingedly connected to the base.

As illustrated in FIGS. 1-9, the present invention is an arrow quiver, indicated generally at 10, for holding and transporting broadhead arrows 12. While the arrow quiver 10 of the present invention has been and will hereafter be described as holding and transporting broadhead arrows 12, the arrow quiver 10 can be used on any type of arrow, either hunting or recreational.

The arrow quiver 10 of the present invention includes a blade hood 14 for receiving the blades 16 of the broadhead arrows 12, a gripper or arrow holder 18, a cross member 20 connecting and holding the gripper 18 and the blade hood 14 together, and an attachment mechanism (not shown) for mounting the arrow quiver 10 to the bow (not shown). Preferably, the cross member 20 has a bend portion 21 which allows alignment of the gripper 18 with the blade hood 14. The attachment mechanism can either be a quick detach attachment mechanism or a solid bow mounted piece, depending on the desires of the manufacturer and/or archer.

As illustrated in FIGS. 1-5, the blade hood 14 of the arrow quiver 10 of the present invention includes a base portion 22 and a cover 24 connected together with at least one hinge mechanism 25. The hinged cover 24 opens relative to the base portion 22 in a clamshell fashion permitting loading of the blades 16 of the broadhead arrows 12 into the arrow quiver 10.

Figure 6:
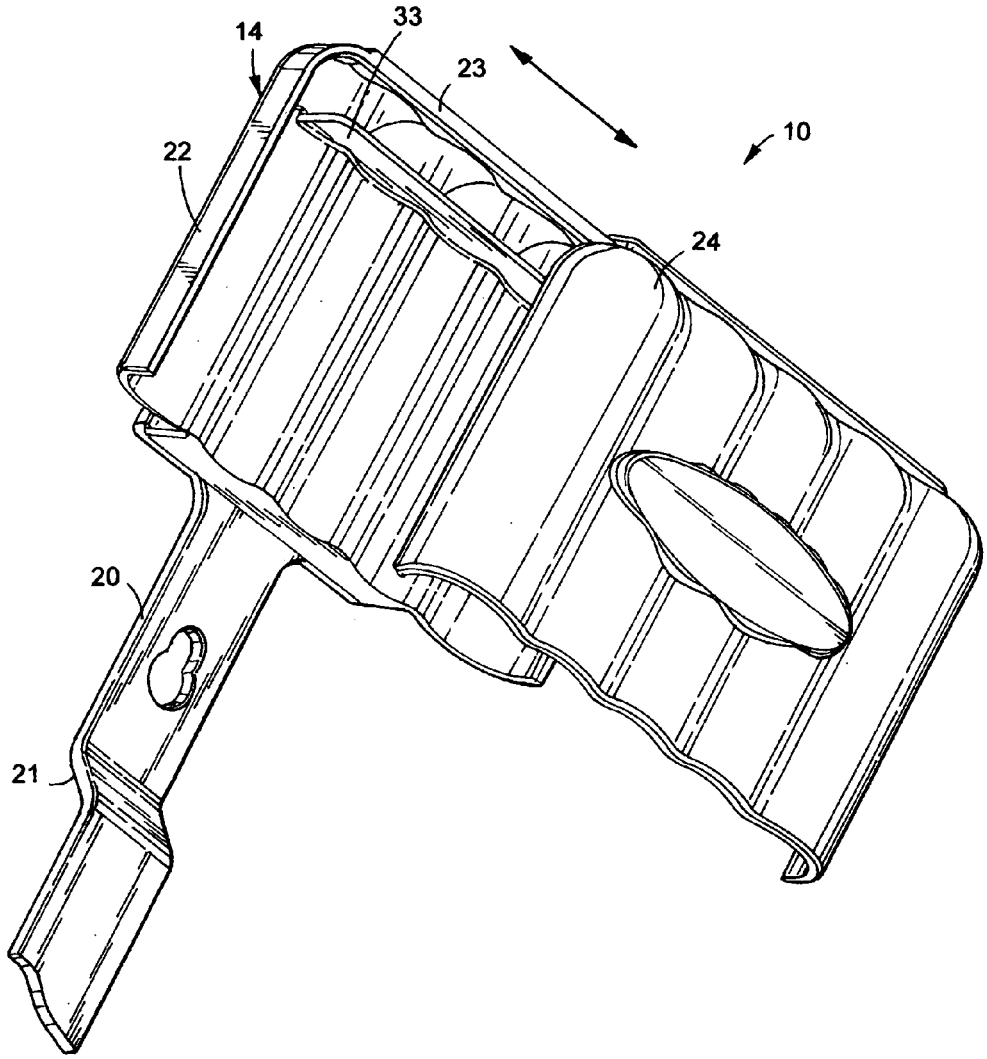
FIG. 6 is a perspective view of still another embodiment of the arrow quiver for carrying arrows, constructed in accordance with the present invention, with a cover slidable from the base for accessing the arrows.
Figure 7:
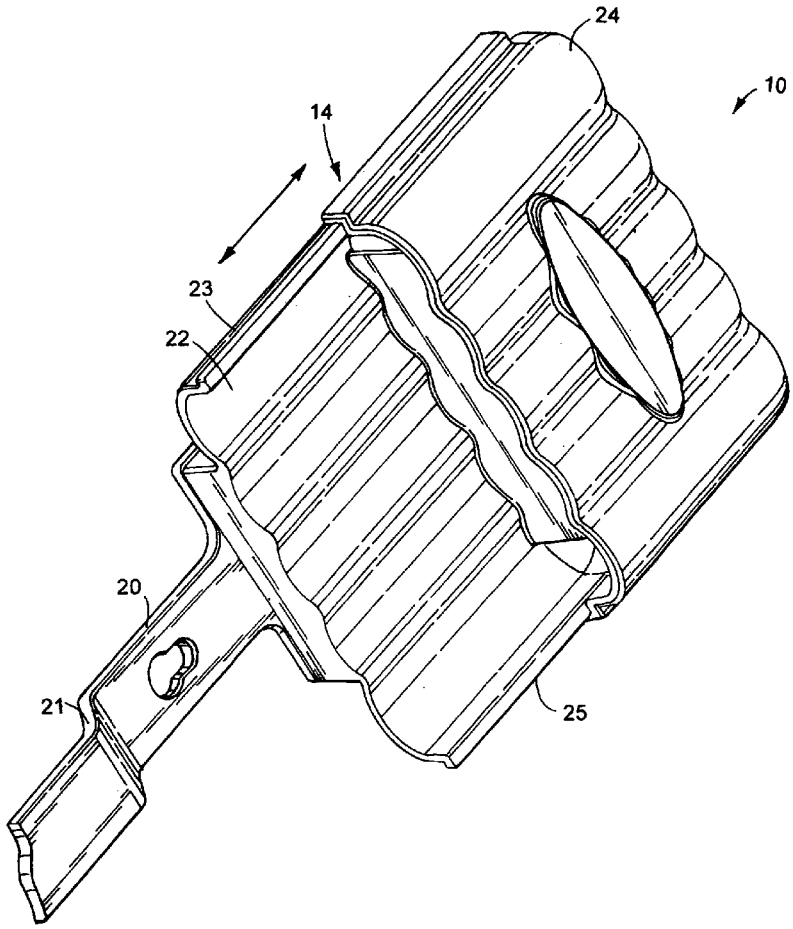
FIG. 7 is a perspective view of yet another embodiment of the arrow quiver for carrying arrows, constructed in accordance with the present invention, with a cover slidable from the base for accessing the arrows.

As illustrated in FIGS. 6 and 7, the cover 24 can be slidably connected to the base portion 22 for moving the cover 24 onto and off the base portion 22. The base portion 22 and the cover 24 include at least one rail 23 for allowing the cover 24 to slide relative to the base portion 22. A stop mechanism (not shown) can be provided to limit the sliding extend of the cover 24 relative to the base portion 22 such that the cover 24 never completely leaves the base portion.

Figure 8:
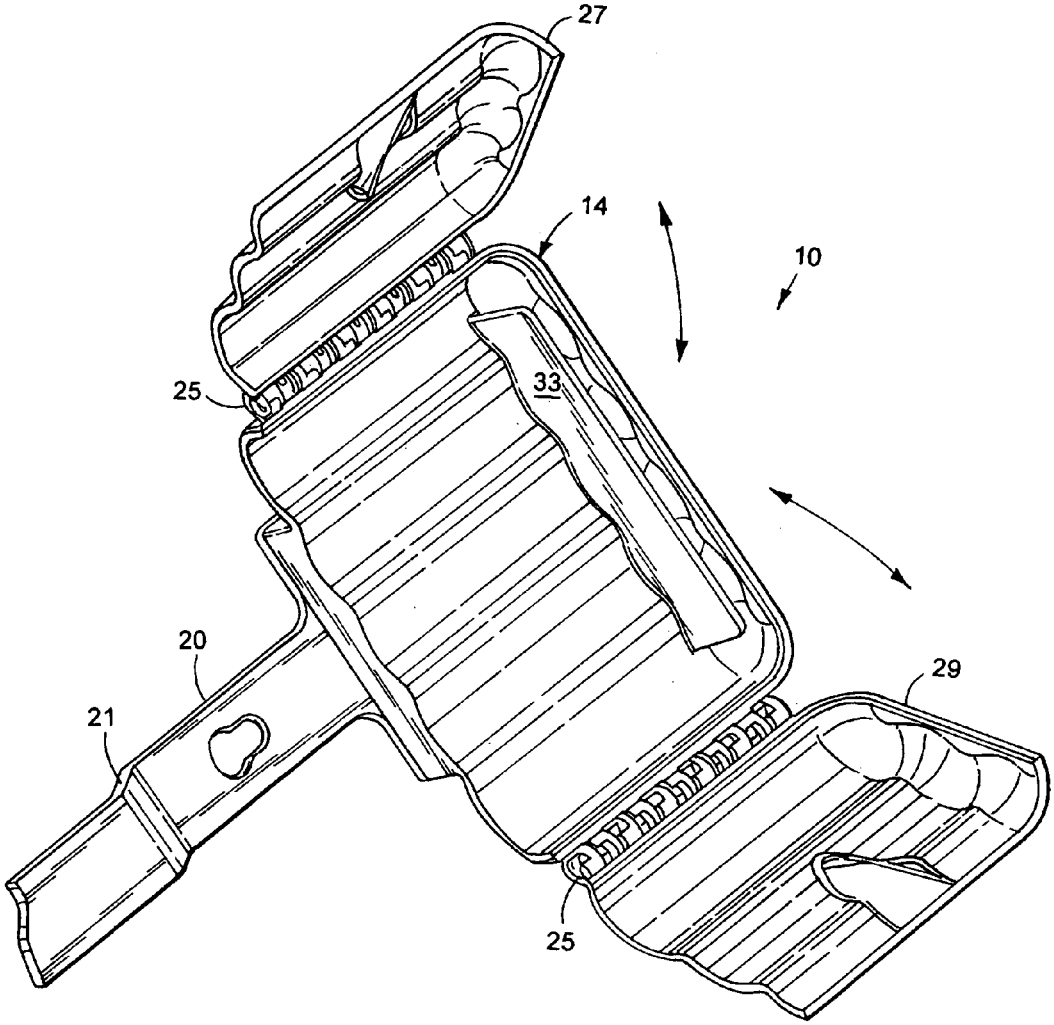
FIG. 8 is a perspective view of yet another embodiment of the arrow quiver for carrying arrows, constructed in accordance with the present invention, with a two-part cover hingedly connected to the base.

As illustrated in FIG. 8, the cover 24 can includes a first cover portion 27 and a second cover portion 29 which are each separately hinged to the base portion 22. Constructing the cover 24 in this manner allows the user to open one or both cover portions 27, 29 depending on the desire of the user.

Figure 9:
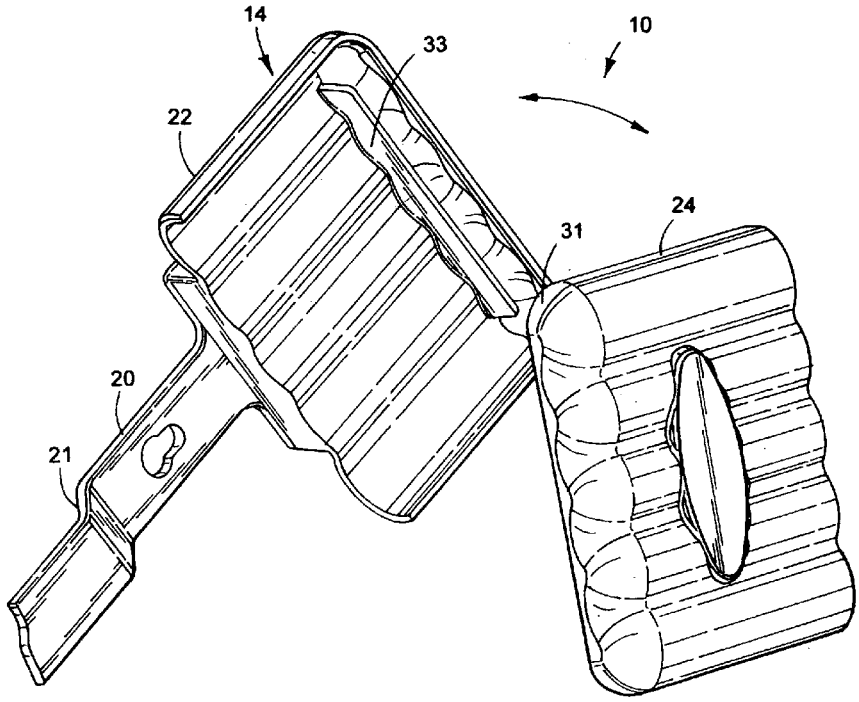
FIG. 9 is a perspective view of yet another embodiment of the arrow quiver for carrying arrows, constructed in accordance with the present invention, with a cover pivotable away from the base for accessing the arrows.

As illustrated in FIG. 9, the cover 24 can be pivotally connected to the base portion 22 through a pivot point 31. The cover 24 pivots relative to the base portion 24 about the pivot point 31 allowing the user to access the arrows 12.

In each of the embodiments described above, the arrow quiver 10 can include a wall 33 formed on the base portion 24. The wall 33 provides a stop point for the blades 16 of the arrows 12 to limit the extent of the arrows within the blade hood 14.

Resilient foam material 26 can be placed in both the base portion 22 and the hinged cover 24 of the blade hood 14 and grooved on at least one side to accommodate a variety of blades 16 of broadhead arrows 12 including mechanical broadhead arrows. In another embodiment, fur or the like can be secured within the blade hood 14 for protecting the blades 16. Also, the resilient foam material 26 can be secured to the wall 33 to protect the tips of the blades 16. Through these components, mechanical broadhead arrows 12 can be placed in the quiver 10, carried, and withdrawn for use without damaging the broadhead arrows 12 or causing the blades 16 of the broadhead arrows 12 to open prematurely.

While the arrow quiver 10 of the present invention has been described as being hinged, it is within the scope of the present invention to have the cover 24 of the blade hood 14 be completely removable from the base portion 22 of the blade hood 14 without the use of hinges, slides, or pivot points. In any of the embodiments of the arrow quiver 10, fastening mechanisms (not shown) can be attached to the blade hood 14, either the base portion 22 or the hinged cover 24 or both, to maintain the blade hood 14 in a closed condition.

The blade hood 14 of the arrow quiver 10 can be constructed from any durable material. In a preferred embodiment, the blade hood 14 is constructed from a plastic material, although other materials including, but not limited to, metal, wood, ceramics, etc., are within the scope of the present invention. In addition, the blade hood 14, including both the base portion 22 and the cover 24, can be molded to substantially form around the blades 16 of the arrows 12.

In sum, the arrow quiver 10 of the present invention which can be opened or removed for the insertion or removal of broadhead arrows 12 thereby allowing the broadhead arrows 12 to be easily inserted or withdrawn for use. Additionally, the arrow quiver 10 protects the blades 16 of the broadhead arrows 12 from damage and protects the archer from injury. Furthermore, the arrow quiver 10 maintains the broadhead arrows 12 from inadvertently opening prior to contact with an intended target.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. An arrow quiver for carrying arrows, each arrow having a blade end, a feather end, and an elongated shaft between the blade end and the feather end, the arrow quiver comprising:

a cross member having a first end and a second end;

a gripping mechanism secured to the first end of the cross member, the gripping mechanism substantially surrounding and releasably gripping the elongated shaft only between the blade end and the feather end; and a blade hood secured to the second end of the cross member for forming a blade receiving pocket, the blade hood having a base and a cover, the cover movable from the base, the blade receiving pocket being open on at least one side;

wherein the cover is hingedly connected to the base for moving the cover away from the base and opening the blade receiving pocket; and wherein the blade hood receives and covers the blade end and a portion of the elongated shaft only.

2. The arrow quiver of claim 1 wherein the cover includes a first cover portion and a second cover portion, the first cover portion and the second cover portion hingedly connected to the base, the first cover portion opening to expose at least a portion of the blade receiving pocket, the second cover portion opening to expose at least a portion of the blade receiving pocket.

3. The arrow quiver of claim 1 wherein the cover slides relative to the base in a general direction substantially perpendicular to the cross member for opening the blade receiving pocket.

4. The arrow quiver of claim 1 wherein the cover slides relative to the base in a general direction substantially parallel to the cross member for opening the blade receiving pocket.

5. The arrow quiver of claim 1 wherein the cover is pivotably connected to the base for rotating the cover away from the base and opening the blade receiving pocket.

6. The arrow quiver of claim 1 and further comprising:

a wall secured to the base within the blade receiving pocket.

7. The arrow quiver of claim 1 and further comprising:

material secured within the blade hood.

8. The arrow quiver of claim 1 wherein the blade hood is molded to substantially form about the blades of the arrows.

9. The arrow quiver of claim 1 wherein the cross member has a bend portion for aligning the gripping mechanism with the blade hood.

10. The arrow quiver of claim 1 wherein the feather end extends beyond the gripping mechanism and is free from being covered.

11. An arrow quiver for carrying arrows, the arrow quiver comprising:

a cross member having a first end and a second end;

a gripping mechanism secured to the first end of the cross member; and a blade hood secured to the second end of the cross member for forming a blade receiving pocket, the blade hood having a base and a cover, the cover movable from the base;

wherein the cover is hingedly connected to the base for moving the cover away from the base and opening the blade receiving pocket; and wherein the cover includes a first cover portion and a second cover portion, the first cover portion and the second cover portion hingedly connected to the base, the first cover portion opening to expose at least a portion of the blade receiving pocket, the second cover portion opening to expose at least a portion of the blade receiving pocket.

12. An arrow quiver for carrying arrows, the arrow quiver comprising:

a cross member having a first end and a second end;

a gripping mechanism secured to the first end of the cross member; and a blade hood secured to the second end of the cross member for forming a blade receiving pocket, the blade hood having a base and a cover, the cover movable from the base;

wherein the cover slides relative to the base in a general direction substantially perpendicular to the cross member for opening the blade receiving pocket.

13. An arrow quiver for carrying arrows, the arrow quiver comprising:

a cross member having a first end and a second end;

a gripping mechanism secured to the first end of the cross member; and a blade hood secured to the second end of the cross member for forming a blade receiving pocket, the blade hood having a base and a cover, the cover movable from the base;

wherein the cross member has a bend portion for aligning the gripping mechanism with the blade hood;

wherein the cover is hingedly connected to the base for moving the cover away from the base and opening the blade receiving pocket; and wherein the cover includes a first cover portion and a second cover portion, the first cover portion and the second cover portion hingedly connected to the base, the first cover portion opening to expose at least a portion of the blade receiving pocket, the second cover portion opening to expose at least a portion of the blade receiving pocket.

14. The arrow quiver of claim 13 wherein the cover is pivotably connected to the base for rotating the cover away from the base and opening the blade receiving pocket.

15. The arrow quiver of claim 13 and further comprising:

a wall secured to the base within the blade receiving pocket.

16. The arrow quiver of claim 13 and further comprising:

material secured within the blade hood.

17. An arrow quiver for carrying arrows, each arrow having a blade end, a feather end, and an elongated shaft between the blade end and the feather end, the arrow quiver comprising:

a cross member having a first end and a second end;

a gripping mechanism secured to the first end of the cross member;

a blade hood secured to the second end of the cross member for forming a blade receiving pocket, the blade hood having a base and a cover, the cover movable from the base, the blade receiving pocket being open on at least one side; and a wall secured to the base within the blade receiving pocket;

wherein the cover is hingedly connected to the base for moving the cover away from the base and opening the blade receiving pocket; and wherein the blade hood receives and covers the blade end and a portion of the elongated shaft only.

* * * * *